US010862229B2

(12) United States Patent
Yamane et al.

(10) Patent No.: US 10,862,229 B2
(45) Date of Patent: Dec. 8, 2020

(54) FUSE CLIP AND CONNECTOR

(71) Applicants: Tyco Electronics Japan G.K., Kawasaki (JP); TOYOTA JIDOSHA KABUSHIKI KAISHA, Toyota (JP)

(72) Inventors: Tomokazu Yamane, Kawasaki (JP); Seiji Komatsu, Kawasaki (JP); Makoto Motono, Toyota (JP)

(73) Assignees: Toyota Jidosha Kabushiki Kaisha, Toyota (JP); Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/449,954

(22) Filed: Jun. 24, 2019

(65) Prior Publication Data

US 2019/0393625 A1 Dec. 26, 2019

(30) Foreign Application Priority Data

Jun. 26, 2018 (JP) ..... 2018-120330

(51) Int. Cl.

| | |
|---|---|
| ***H01R 13/684*** | (2011.01) |
| ***H01R 9/16*** | (2006.01) |
| ***H01H 85/04*** | (2006.01) |
| ***H01R 13/629*** | (2006.01) |

(52) U.S. Cl.

CPC ..... *H01R 9/16* (2013.01); *H01H 85/04* (2013.01); *H01R 13/62933* (2013.01); *H01R 13/684* (2013.01)

(58) Field of Classification Search

CPC .... H01H 85/202; H01H 85/24; H01H 31/122; H01H 85/205; H01H 85/04; H01R 13/6658; H01R 9/16; H01R 13/62933

USPC ..... 439/620.26

See application file for complete search history.

(56) References Cited

U.S. PATENT DOCUMENTS 4,761,148 A * 8/1988 Sappington ..... H01H 85/24 337/226
4,801,278 A * 1/1989 Sappington ..... H01H 85/202 439/746
5,618,209 A * 4/1997 Lin ..... H01H 85/205 439/620.26
6,326,878 B1 * 12/2001 Liang ..... H01H 85/202 337/214

(Continued)

FOREIGN PATENT DOCUMENTS

JP 6-7143 U 1/1994
JP 2014146451 A 8/2014

*Primary Examiner* — Jean F Duverne
(74) *Attorney, Agent, or Firm* — Barley Snyder

(57) ABSTRACT

A fuse clip comprising a pair of first springs configured to support a fuse having a cylindrical body part from a radially outer side and a pair of second springs disposed side by side with the first springs in an axial direction of the fuse and configured to elastically support the fuse from the radially outer side. The first springs are configured to elastically support the cylindrical body part at a point of intersection between a horizontal line segment passing through a center of the cylindrical body part and an outer circumferential surface of the cylindrical body part or at a position higher than the point of intersection. The second springs are configured to elastically support the cylindrical body part at a higher position with respect to the point of intersection than the first springs elastically support the cylindrical body part.

10 Claims, 11 Drawing Sheets

(56) References Cited

U.S. PATENT DOCUMENTS

| | | | | |
|---|---|---|---|---|
| 9,028,267 | B2 | 5/2015 | Furuya et al. | |
| 2004/0166735 | A1* | 8/2004 | Gibboney ..... | H01R 13/6658<br>439/620.26 |
| 2009/0243786 | A1* | 10/2009 | Buettner ..... | H01H 31/122<br>337/203 |

* cited by examiner

FUSE CLIP AND CONNECTOR

CROSS-REFERENCE TO RELATED APPLICATIONS

This application claims the benefit of the filing date under 35 U.S.C. § 119(a)-(d) of Japanese Patent Application No. 2018-120330, filed on Jun. 26, 2018.

FIELD OF THE INVENTION

The present invention relates to a fuse clip and, more particularly, to a fuse clip that is used to fix a fuse in a predetermined position.

BACKGROUND

A fuse clip is used to fix a fuse having a cylindrical body part in a predetermined position. JP 6-7143 U discloses a non-polar fuse clip that does not require high processing accuracy. The fuse clip includes an auxiliary holding portion that is provided on each side of a fuse holding portion, the auxiliary holding portion having a base part integrated with the fuse holding portion while an upper part of the base part is separated from the fuse holding portion.

When a cartridge fuse is inserted into the fuse clip of JP 6-7143 U, metal caps of the cartridge fuse are supported by the fuse holding portions. The auxiliary holding portions come into contact with an outer surface of an insulating tube and supplementarily support the insulating tube, while simultaneously preventing the cartridge fuse from coming off or slipping out in an axial direction.

When a heavy-weight cartridge fuse is used in an environment prone to vibration, significant vibration of the cartridge fuse occurs. As a result, in extreme cases, the cartridge fuse slips out of the fuse clip. One example of applications in such a vibration-prone environment is a service plug device installed in an electric vehicle as disclosed in JP 2014-146451 A. The service plug device is provided for the purpose of shutting off power to secure the safety during maintenance of a battery unit.

Having the auxiliary holding portions in addition to the fuse holding portions, the fuse clip of JP 6-7143 U can firmly support a cartridge fuse with a strong elastic force. In the fuse clip of JP 6-7143 U, the fuse supporting portion and the auxiliary supporting portion have circular-arc surfaces, and these circular-arc surfaces come into surface contact with the cartridge fuse. Supporting the cartridge fuse by surface contact has the advantage of being able to provide firm support.

While such firm support is effective against vibration, it causes an increase in the operating force required to insert and remove a cartridge fuse into and from the fuse clip. During insertion and removal of the cartridge fuse, the fuse supporting portion and the auxiliary supporting portion need to be deflected outward. However, compared with a flat spring, a spring having a circular-arc surface has high rigidity against outward deflection. Accordingly, the work of inserting and removing the fuse into and from spring portions of which circular-arc surfaces come into surface contact with the fuse is a large burden.

SUMMARY

A fuse clip comprising a pair of first springs configured to support a fuse having a cylindrical body part from a radially outer side and a pair of second springs disposed side by side with the first springs in an axial direction of the fuse and configured to elastically support the fuse from the radially outer side. The first springs are configured to elastically support the cylindrical body part at a point of intersection between a horizontal line segment passing through a center of the cylindrical body part and an outer circumferential surface of the cylindrical body part or at a position higher than the point of intersection. The second springs are configured to elastically support the cylindrical body part at a higher position with respect to the point of intersection than the first springs elastically support the cylindrical body part.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
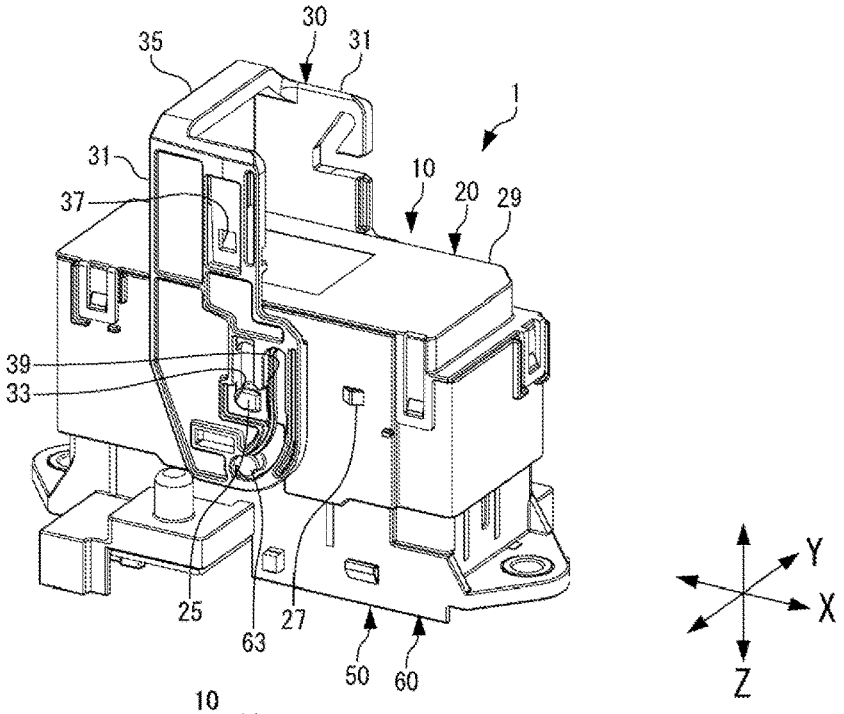
FIG. 1A is a perspective view of a connector according to an embodiment in a state before mating.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art.

A connector 1 according to the embodiment has a configuration that allows a fuse clip 70 to support a heavy cylindrical fuse 40 in a vibration-prone environment so as to prevent the fuse 40 from slipping out of the fuse clip 70. In the connector 1, a pair of first springs 74, 74 and a pair of second springs 75, 75 of the fuse clip 70 serve to support the fuse 40. The burden of the work of inserting and removing the fuse 40 into and from the fuse clip 70 can be thereby reduced.

As shown in FIGS. 1A-2B, the connector 1 includes a lever assembly 10 and a cap assembly 50. The lever assembly 10 and the cap assembly 50 are assembled in the pre-mating state shown in FIG. 1A, and then a lever 30 of the lever assembly 10 is turned down to the intermediate position shown in FIG. 1B. Further, the lever 30 is horizontally moved as shown in FIG. 1C, which completes mating of the lever assembly 10 and the cap assembly 50 with each other. When the lever 30 is conversely turned up from the position of FIG. 1B to the position of FIG. 1A, the lever assembly 10 and the cap assembly 50 are unmated from each other.

Figure 7A:
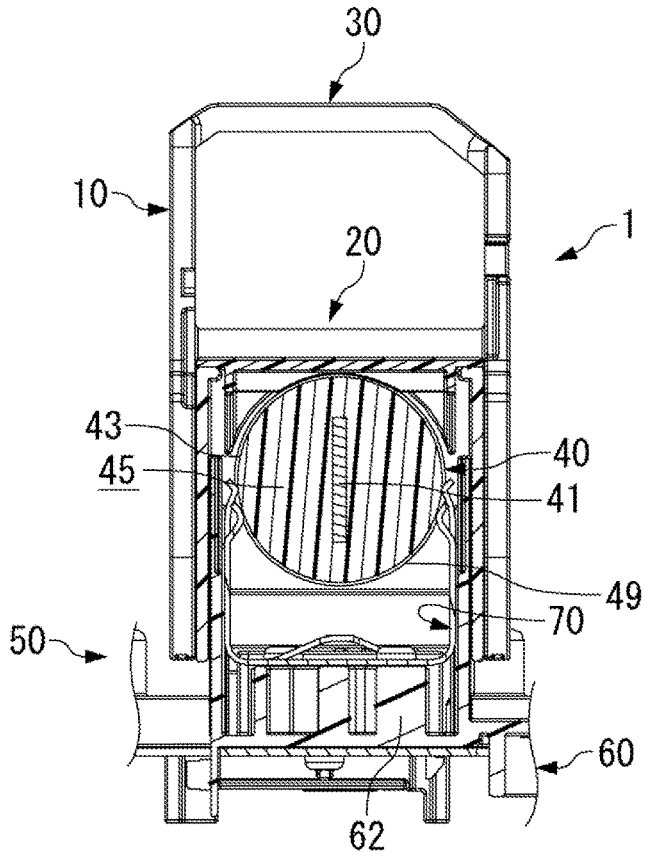
FIG. 7A is a sectional side view of the connector before mating.
Figure 7B:
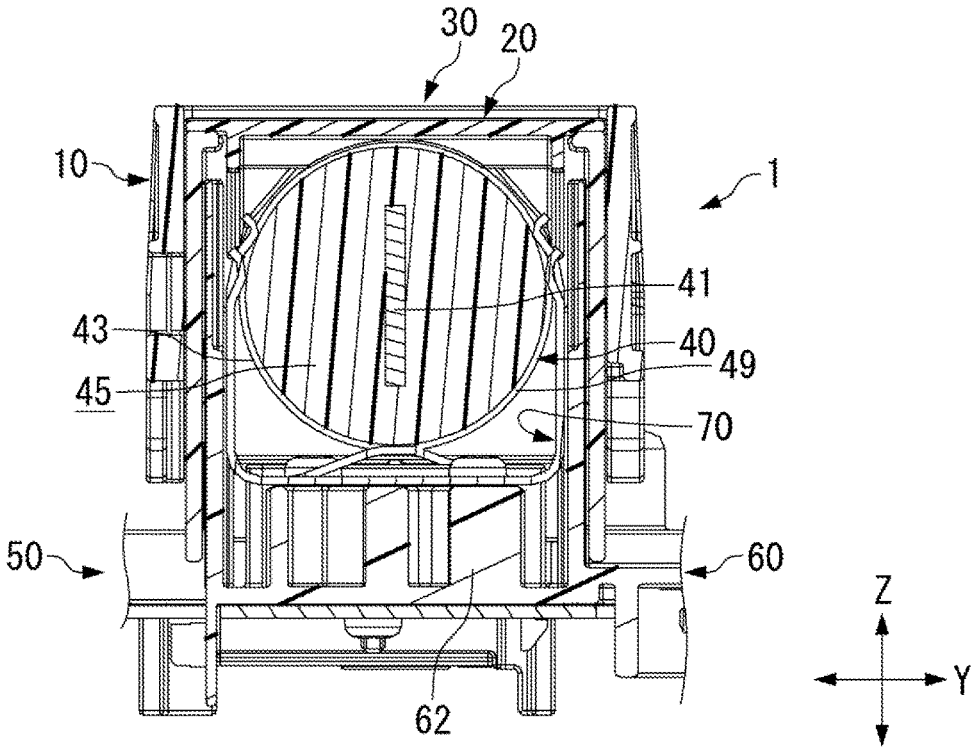
FIG. 7B is a sectional side view of the connector after mating.

In the unmated state, the fuse 40 is merely placed on the fuse clip 70 as shown in FIG. 7A. Upon completion of mating, however, the fuse 40 is supported by the fuse clip 70 with an elastic force as shown in FIG. 7B.

Figure 2A:
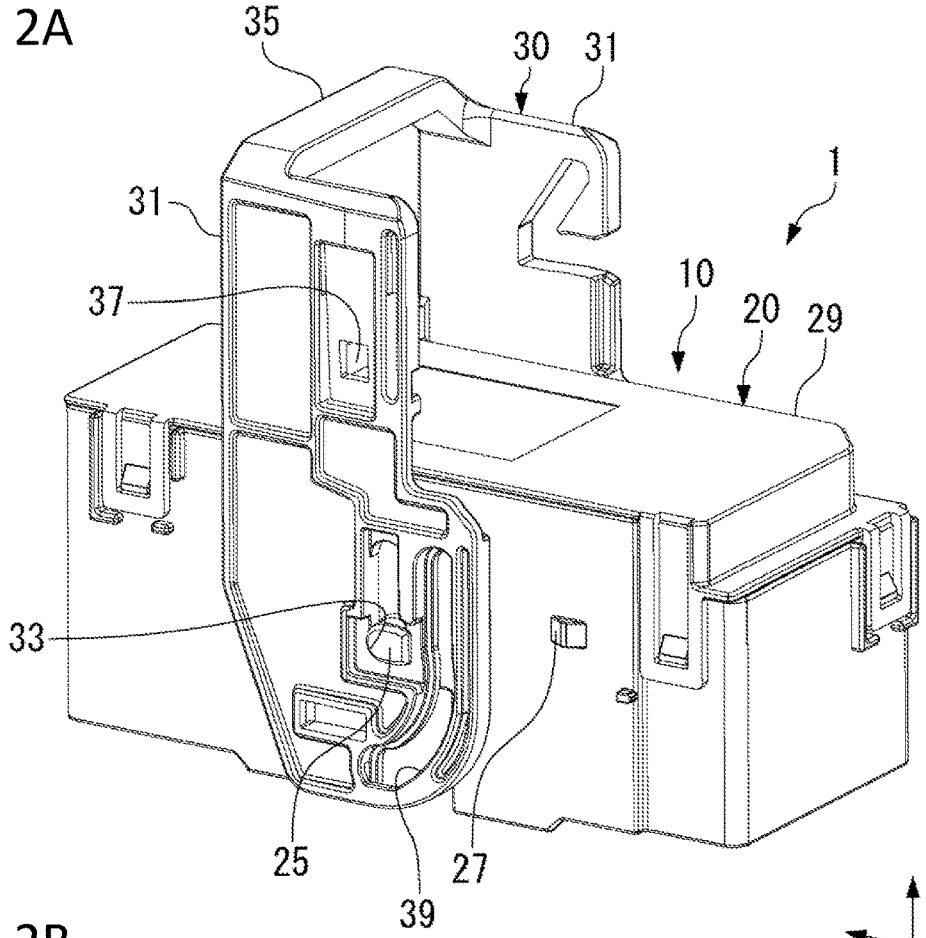
FIG. 2A is a perspective view of a lever assembly of the connector.
Figure 2B:
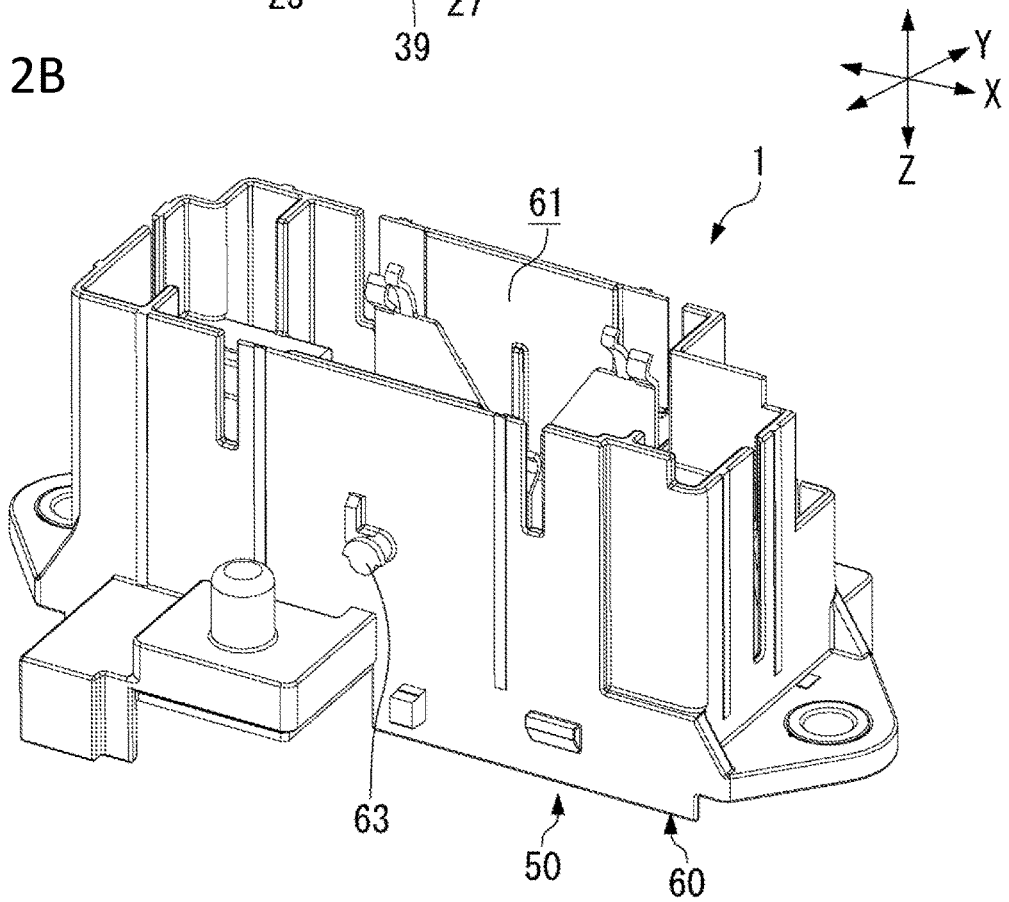
FIG. 2B is a perspective view of a cap assembly of the connector.
Figure 3:
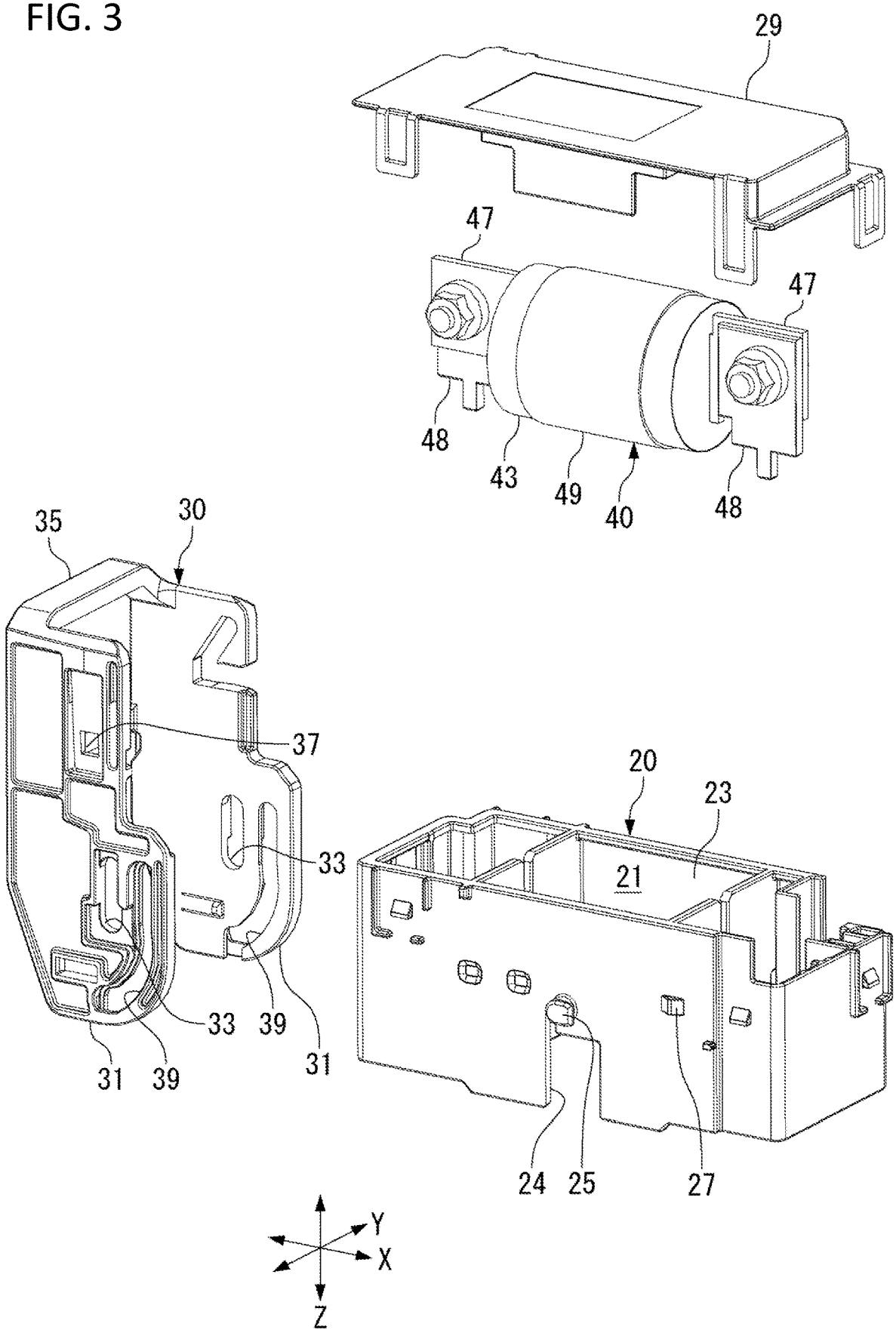
FIG. 3 is an exploded perspective view of the lever assembly.

As shown in FIGS. 2A and 3, the lever assembly 10 includes an outer housing 20 and the lever 30 pivotally mounted on the outer housing 20. The lever assembly 10 further includes a fuse cover 29 covering an opening 23 of the outer housing 20, and the cylindrical fuse 40 accommodated in the outer housing 20. The outer housing 20 corresponds to the first housing of the present invention. In addition to accommodating the fuse 40 therein, the outer housing 20 rotatably supports the lever 30.

As shown in FIG. 3, the outer housing 20 is open at both sides in a height direction Z (the upper side and the lower side in FIG. 3), and has a fuse accommodating chamber 21 that is a space to accommodate the fuse 40, between upper and lower openings 23, 24. When the lever assembly 10 and the cap assembly 50 are mated with each other, the fuse accommodating chamber 21 coincides with a fuse accommodating chamber 61 of the cap assembly 50. Thus, in the mated state of the lever assembly 10 and the cap assembly 50, the fuse 40 is accommodated in the fuse accommodating chamber 21 and the fuse accommodating chamber 61 coinciding with each other from inside and outside.

In this embodiment, the connector 1 is disposed such that the height direction Z matches a vertical direction and that a width direction Y matches a horizontal direction.

A pair of turning shafts 25, 25 that respectively pivotally support side bodies 31, 31 of the lever 30 are provided one on each side of the outer housing 20 in the width direction Y, as shown in FIGS. 1A-2A. A locking projection 27 is provided on one side of the outer housing 20 in the width direction Y, at a position away from the turning shaft 25. When the lever 30 is in the mating position, the locking projection 27 is inserted into a locking hole 37 of the side body 31 so as to lock the lever 30.

In an embodiment, the outer housing 20 is integrally formed by injection molding of an electrically insulating resin material. In an embodiment, the lever 30, the fuse cover 29, and a cap housing 60 of the cap assembly 50 are also integrally formed by injection molding.

Figure 1B:
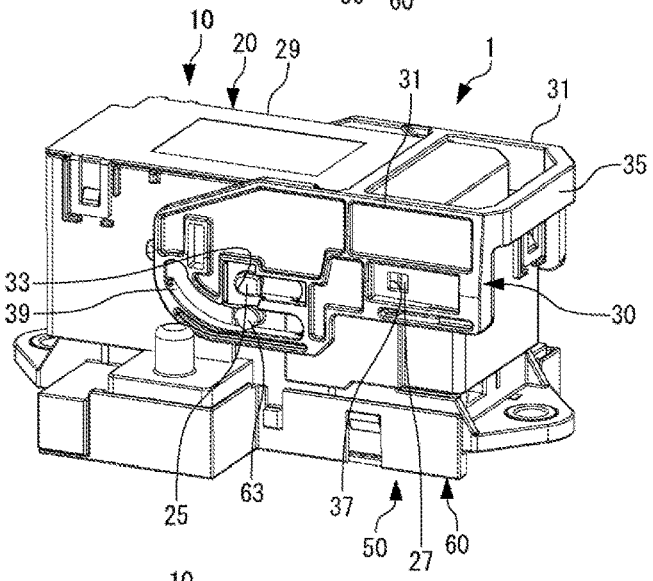
FIG. 1B is a perspective view of the connector in a state during mating.
Figure 1C:
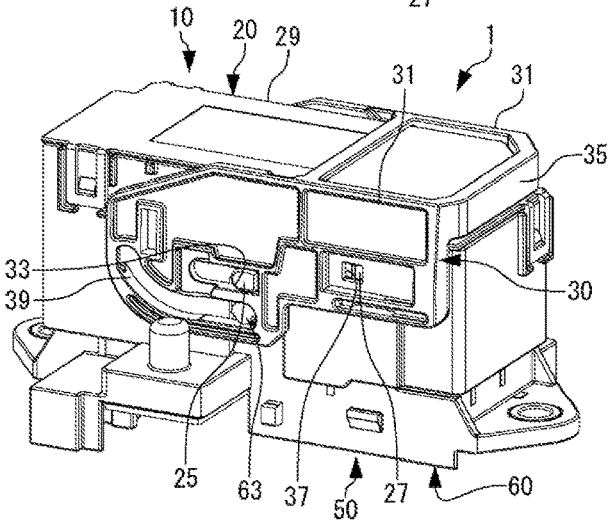
FIG. 1C is a perspective view of the connector in a state after mating.

The lever 30 is mounted on the outer housing 20 so as to be able to turn in a normal direction and a reverse direction around the turning shaft 25, between the unmating position shown in FIG. 1A and the intermediate position shown in FIG. 1B.

As shown in FIGS. 1A and 3, the lever 30 includes the pair of side bodies 31, 31 that are each pivotally supported at one end by the outer housing 20 and extend parallel to each other, and a coupling body 35 by which the side bodies 31, 31 are coupled together at the other ends. The side bodies 31, 31 are respectively provided with bearing holes 33, 33 into which the turning shafts 25, 25 of the outer housing 20 are inserted. The bearing holes 33, 33 are formed by elongated holes so that the lever 30 can be moved horizontally from the intermediate position to the mating-completion position.

One side body 31 has the locking hole 37 into which the locking projection 27 is inserted in the mated state. As the locking projection 27 is inserted into the locking hole 37, the lever 30 is restrained from turning from the intermediate position of FIG. 1B toward the unmating position of FIG. 1A.

Each of the side bodies 31, 31 has a cam groove 39, as shown in FIGS. 1A-2A, into which a cam projection 63 provided on the cap housing 60 is inserted. The lever 30 is manipulated from the unmating position through the intermediate position to the mating position, or the lever 30 is manipulated from the mating position through the intermediate position to the unmating position. This causes the cam projection 63 to shift relatively inside the cam groove 39, thereby mating the lever assembly 10 and the cap assembly 50 with each other.

The fuse cover 29 covers the upper opening 23 of the outer housing 20, as shown in FIGS. 1A-2A. The fuse cover 29 presses the fuse 40 downward as the lever 30 turns in the process of mating the lever assembly 10 and the cap assembly 50 with each other. As a result, the fuse 40 is inserted into the fuse clip 70.

When an excessively large current flows through the fuse 40, a fuse element 41 thereof, shown in FIG. 7, is cut by melting to protect an electric circuit connected to terminals 47, 47.

As shown in FIGS. 3 and 7A, the fuse 40 includes the fuse element 41, a metal housing tube 43 accommodating the fuse element 41, and an insulating body 45 surrounding the fuse element 41 inside the housing tube 43. The housing tube 43 constitutes a cylindrical body part. The fuse 40 further includes the terminals 47, 47 respectively connected to both ends of the fuse element 41, and fuse busbars 48, 48 connected to the respective terminals 47, 47. The fuse busbars 48, 48 are supported by clip springs 65, 66, shown in FIG. 4, in the mated state of the lever assembly 10 and the cap assembly 50. The fuse 40 further includes an insulating film 49 covering the housing tube 43 except for both ends of the housing tube 43.

As shown in FIGS. 2B, 4, 5A and 5B, the cap assembly 50 includes the cap housing 60, and the pair of clip springs 65, 66 that are electrically connected to the fuse 40 accommodated in the cap housing 60. The cap assembly 50 further includes a pair of fuse clips 70 that support the fuse 40 inside the cap housing 60.

Figure 4:
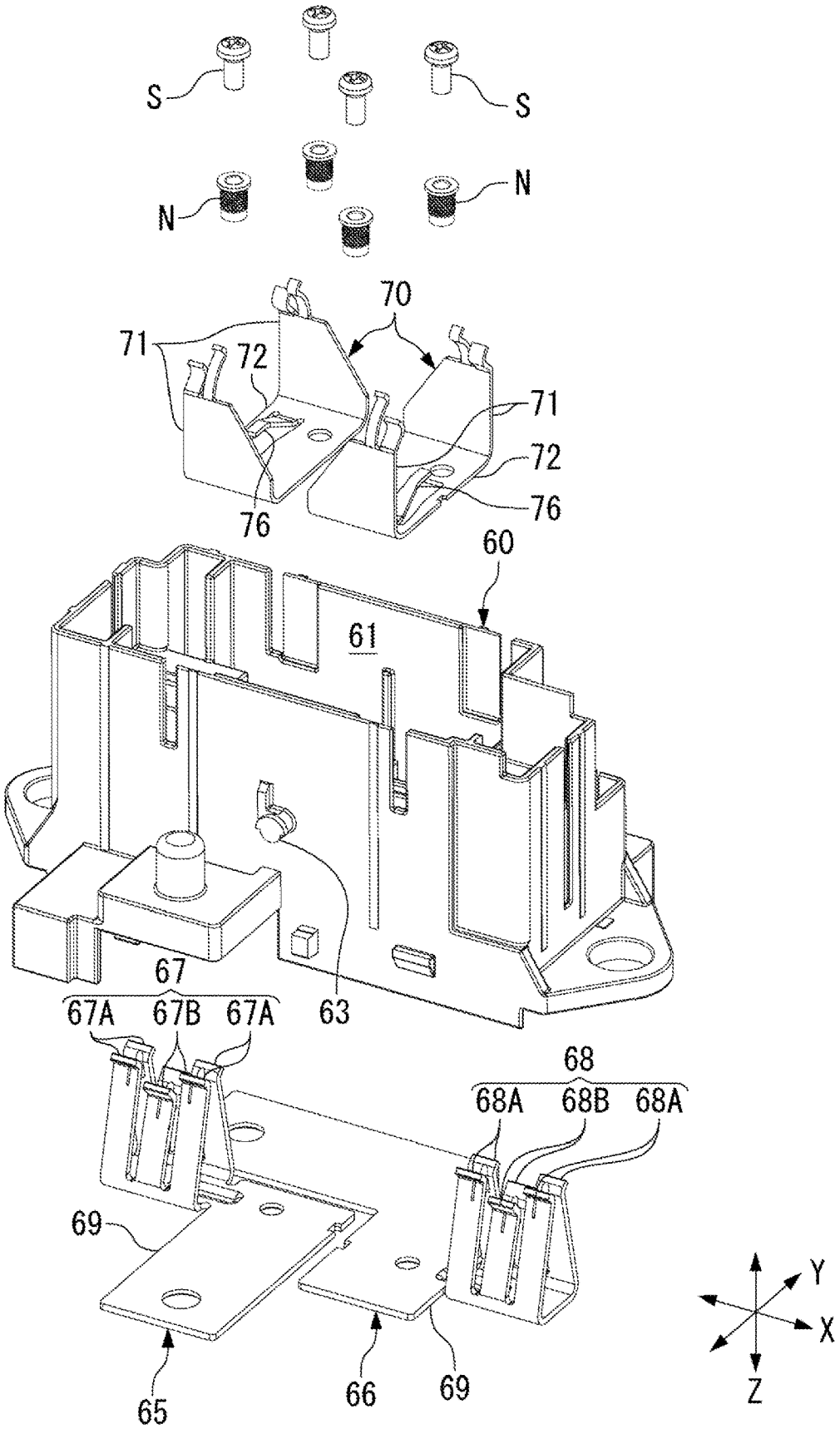
FIG. 4 is an exploded perspective view of the cap assembly.
Figure 5A:
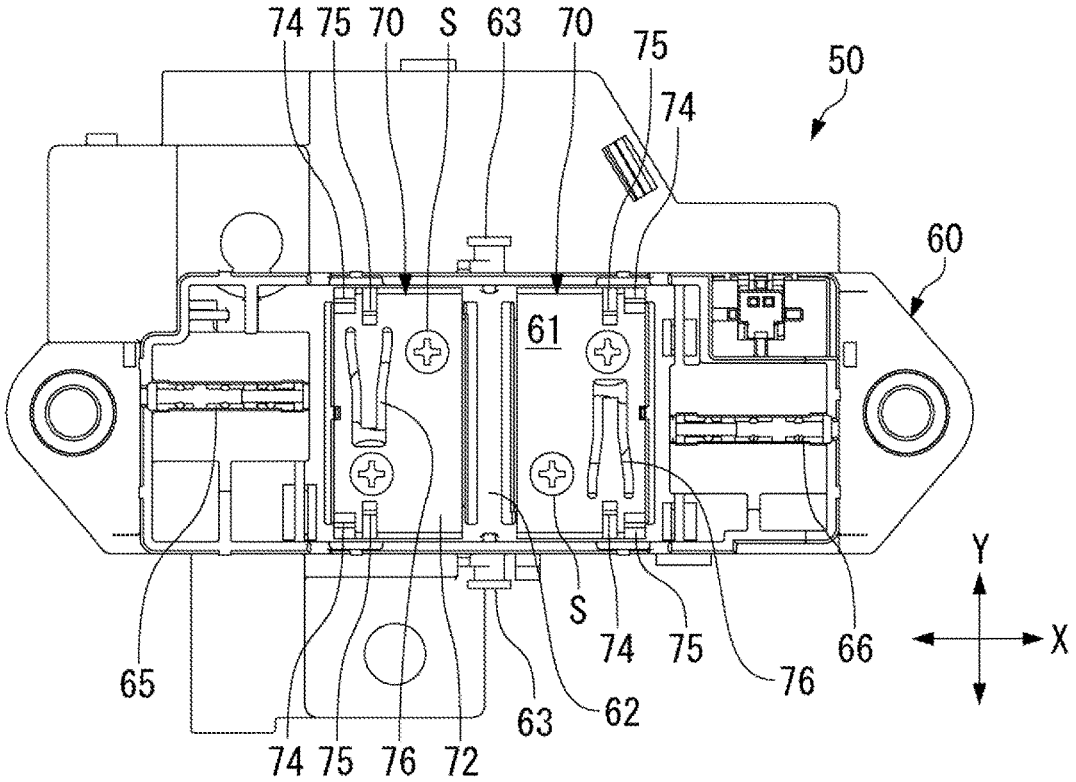
FIG. 5A is a plan view of the cap assembly.
Figure 5B:
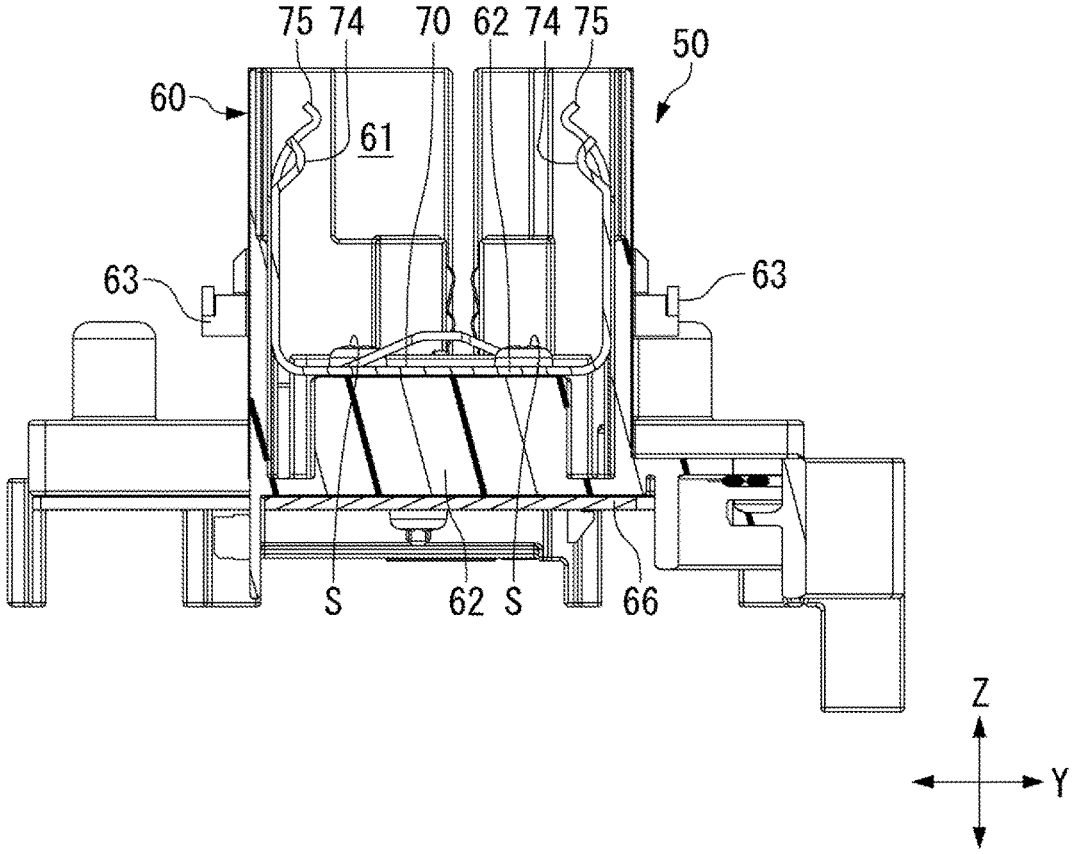
FIG. 5B is a sectional side view of the cap assembly.

As shown in FIGS. 4, 5A, and 5B, the cap housing 60 includes the fuse housing chamber 61 that is open at one side in the height direction Z (the upper side in FIG. 4), and the other side in the height direction Z (the lower side in FIG. 4) of the cap housing 60 is partitioned by a bottom floor 62. As described above, when the lever assembly 10 and the cap assembly 50 are mated with each other, the fuse 40 is accommodated in the fuse housing chamber 21 of the outer housing 20 and the fuse housing chamber 61 that coincide with each other.

The cam projections 63, 63, shown in FIGS. 1A-1C and 2B, to be inserted into the cam grooves 39 of the lever 30 are formed one on each side of the cap housing 60 in the width direction Y. The cap housing 60 corresponds to the second housing of the present invention.

The clip springs 65, 66 respectively have support springs 67, 68, as shown in FIG. 4, that are electrically connected to the fuse busbars 48 of the fuse 40, and support bodies 69 that support the support springs 67, 68. The support spring 67 is formed by a combination of tall spring portions 67A and short spring portions 67B, and the support spring 68 is formed by a combination of tall spring portions 68A and short spring portions 68B. In the support springs 67, 68, the two pairs of spring portions 67A, 67A and the pair of spring portions 67B, 67B are each provided face to face in the width direction. Similarly, the two pairs of spring portions 68A, 68A and the pair of spring portions 68B, 68B are each provided face to face in the width direction.

Figure 8A:
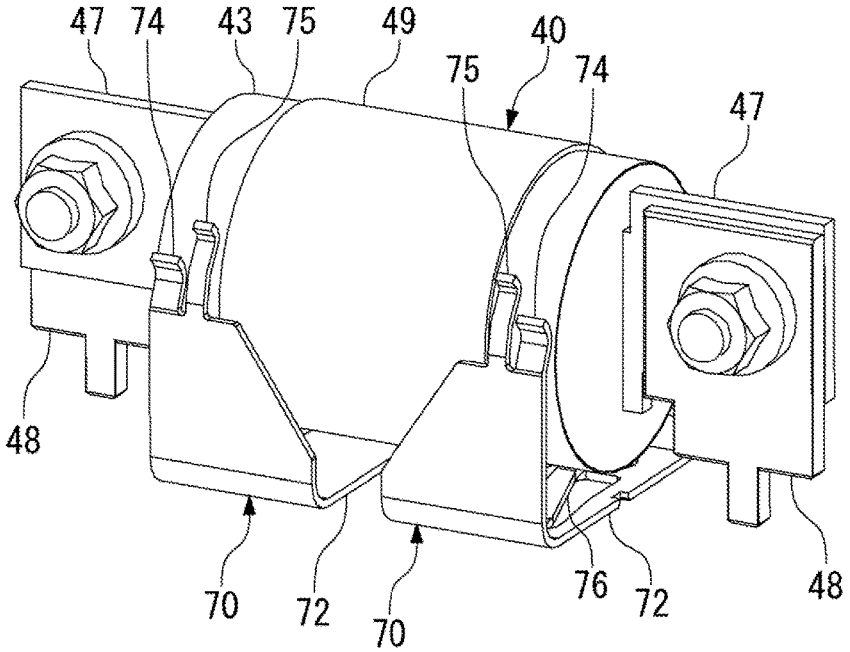
FIG. 8A is a perspective view of the fuse clips supporting a fuse.
Figure 8B:
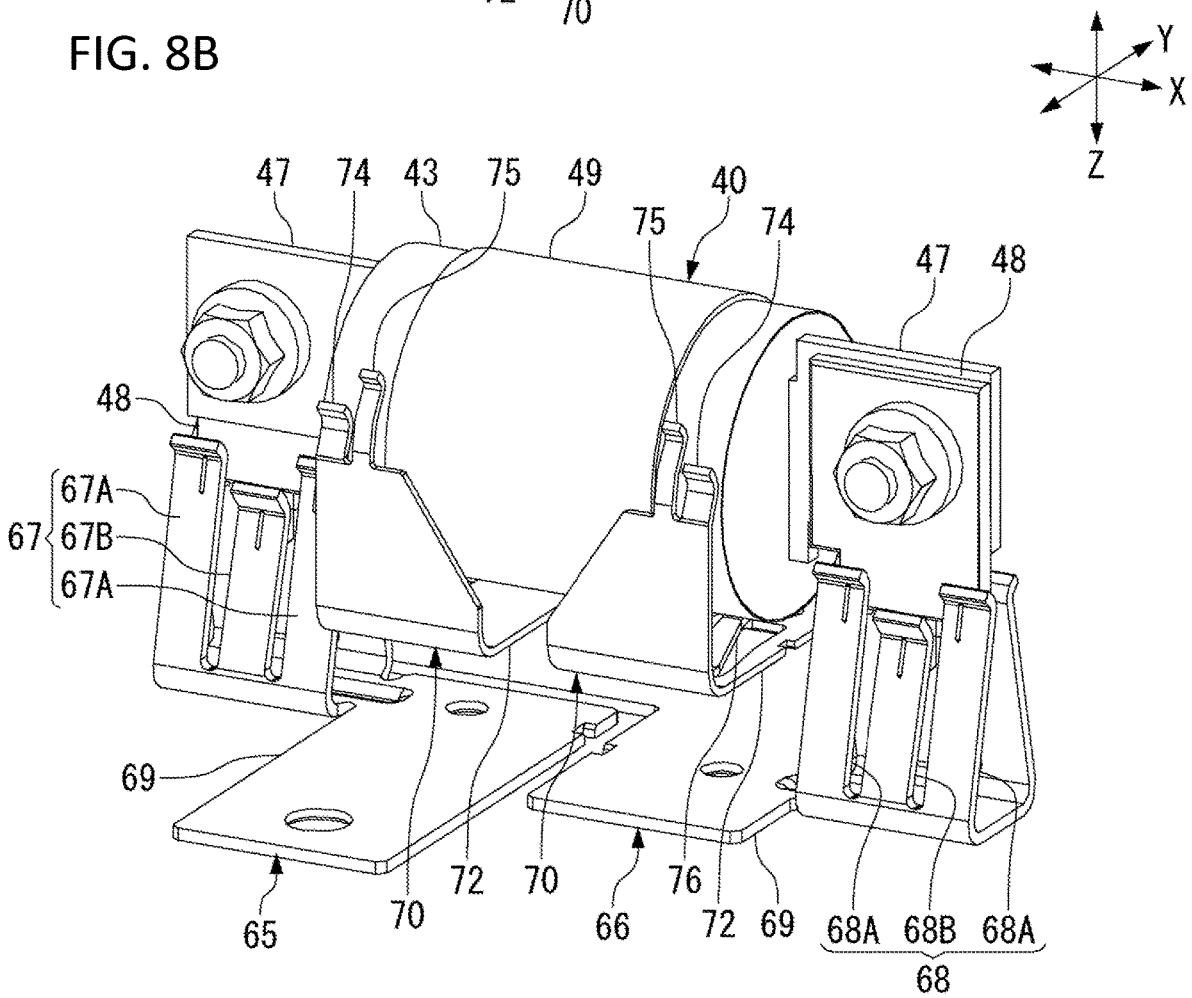
FIG. 8B is a perspective view of the fuse clips supporting a fuse and electrically connected to clip springs.

As shown in FIGS. 5A and 5B, the support bodies 69 of the clip springs 65, 66 are fixed to a bottom surface of the cap housing 60. The support springs 67, 68 of the clip springs 65, 66 extend through the bottom floor 62 and protrude into the fuse housing chamber 61. As shown in FIG. 8B, inside the fuse housing chamber 61, the clip springs 65, 66 support one fuse busbar 48 by the support spring 67 and support the other fuse busbar 48 by the support spring 68.

As shown in FIGS. 5B, 7A, and 7B, the fuse clip 70 elastically supports the fuse 40 in a state of being fixed to the bottom floor 62 of the cap housing 60.

Figure 6A:
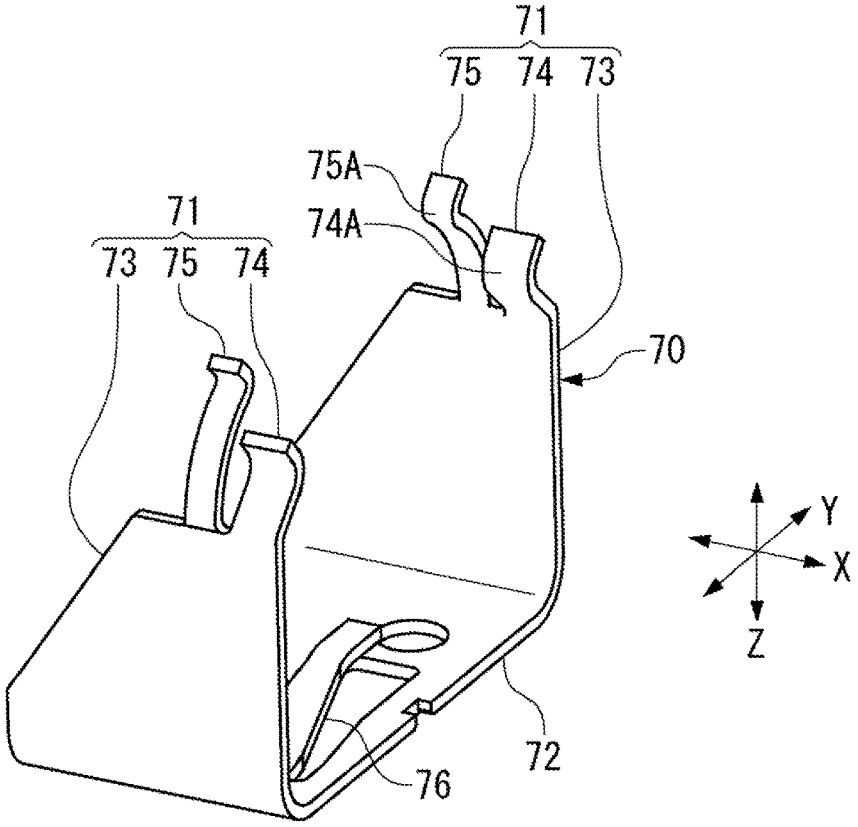
FIG. 6A is a perspective view of a fuse clip of the cap assembly.
Figure 6B:
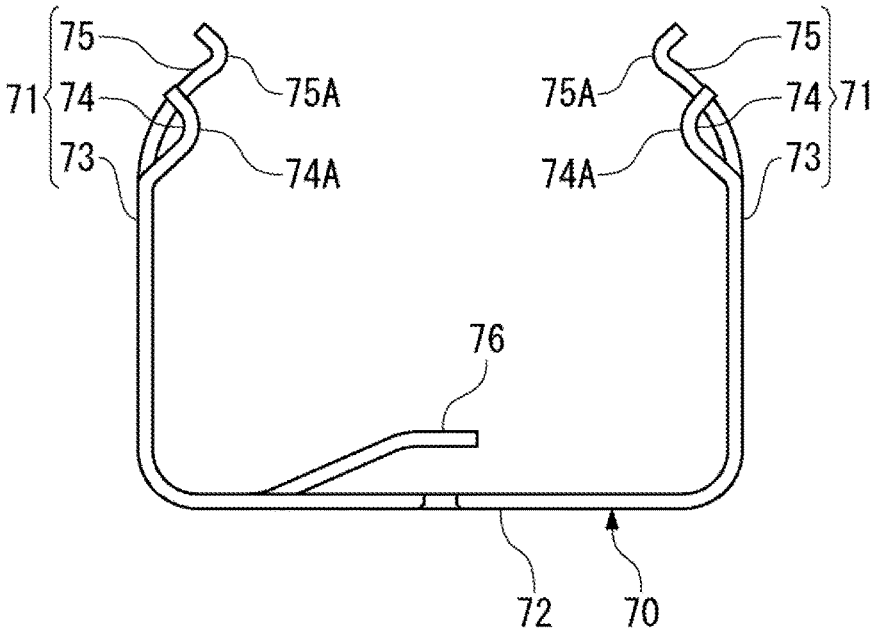
FIG. 6B is a front view of the fuse clip.

As shown in FIGS. 4, 6A, and 6B, the fuse clip 70 includes a pair of support springs 71, 71 that support the fuse 40 from the width direction Y and a support body 72 that supports each of the support springs 71, 71 like a cantilever.

As shown in FIGS. 6A and 6B, each support spring 71 includes a common spring 73 rising from the support body 72, a first spring 74 continuous with the common spring 73, and a second spring 75 continuous with the common spring 73. The support springs 71 and the support body 72 of the fuse clip 70 are integrally formed by stamping and forming a sheet member made of stainless steel, for example. The first spring 74 and the second spring 75 are provided side by side with each other with a small gap left therebetween in a longitudinal direction X, i.e., an axial direction of the fuse 40. The first springs 74, 74 and the second springs 75, 75 are provided at such positions that the first springs 74, 74 face each other and that the second springs 75, 75 face to each other.

Figure 10A:
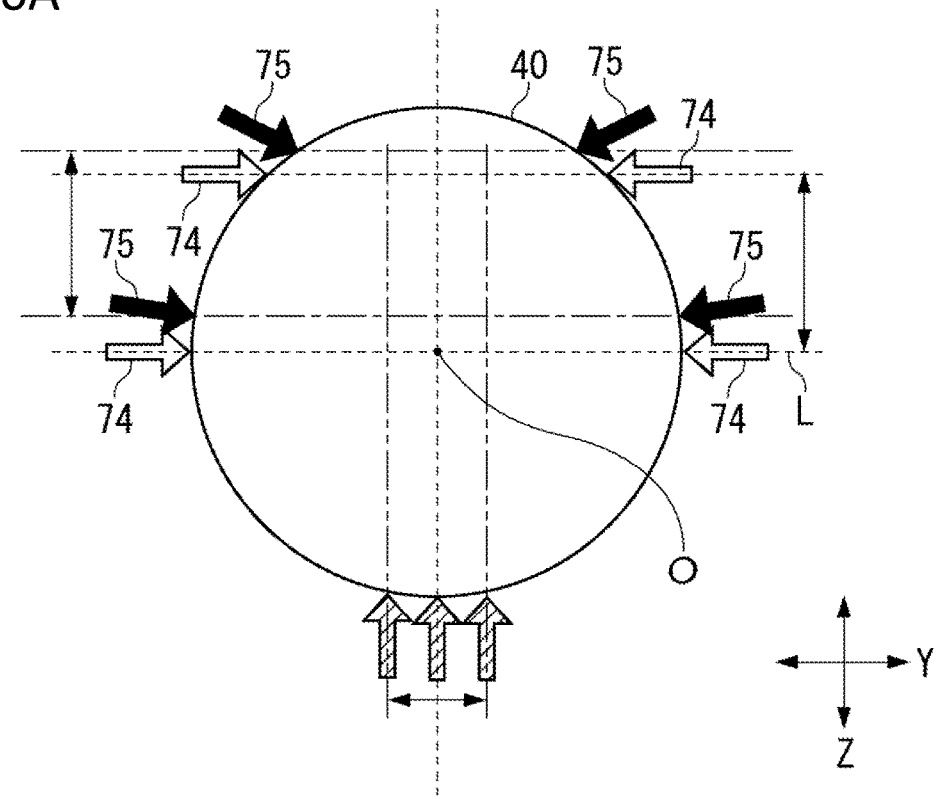
FIG. 10A is a schematic view of ranges of supporting the fuse with the fuse clip.
Figure 10B:
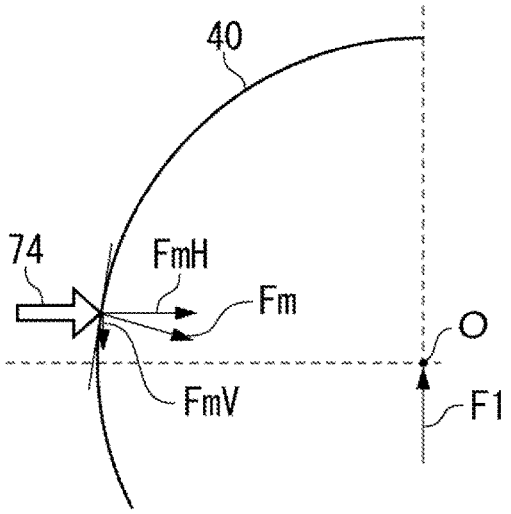
FIG. 10B is a schematic view of the fuse clip supporting the fuse at a position higher than a center of the fuse clip.

The first spring 74 elastically supports the fuse 40 by being pressed against the fuse 40 from a radially outer side and applying a load Fm, shown in FIGS. 10A and 10B, thereto. The second spring 75 also elastically supports the fuse 40 by being pressed against the fuse 40 from the radially outer side and applying a load Fs thereto. The second spring 75 assists the first spring 74 in supporting the fuse 40 such that the fuse 40 supported by the support spring 71 does not slip out upward.

The loads Fm, Fs are loads that the first spring 74 and the second spring 75 respectively apply to the fuse 40 while supporting the fuse 40. The load Fm applied by the first spring 74 is set to be larger than the load Fs applied by the second spring 75 according to the respective functions of the first spring 74 and the second spring 75. To make the load Fm larger than the load Fs, the width of the first spring 74 can be made larger than the width of the second spring 75.

In an embodiment, the load Fm applied by the first spring 74 and the load Fs applied by the second spring 75 are set within the following range:

$$1.5\times\text{load } Fs \leq \text{load } Fm \leq 2.5\times\text{load } Fs$$

The second spring 75 has a larger dimension in the height direction Z from the common spring 73, and is therefore taller, than the first spring 74. The first spring 74 and the second spring 75 respectively have contact points 74A, 75A protruding toward the fuse 40, at portions that hit the fuse 40, as shown in FIGS. 6A and 6B. The contact point 75A protrudes farther toward the center of the support body 72 in the width direction Y than the contact point 74A does. Accordingly, during insertion of the fuse 40 from above into the clearance between the pair of support springs 71, 71, the second springs 75 hit the fuse 40 earlier than the first springs 74 hit the fuse 40. This will be described in greater detail below.

As shown in FIGS. 7A-8B, the form in which the contact points 74A, 75A come into contact with and support the fuse 40 can be called linear contact in the axial direction of the fuse 40. The first spring 74 and the second spring 75 do not support the fuse 40 at regions other than the contact points 74A, 75A.

The support body 72 includes a third spring 76 formed by cutting and raising a portion of the support body 72, as shown in FIGS. 6A and 6B. The third spring 76 supports the fuse 40 upward in the height direction Z, i.e., the vertical direction.

As shown in FIGS. 4 and 5A, the fuse clip 70 is fixed to the bottom floor 62 of the cap housing 60 with pluralities of screws S and nuts N. In this embodiment, two fuse clips 70 support one fuse 40. As shown in FIGS. 8A and 8B, the first spring 74 and the second spring 75 support both end sides of the metal housing tube 43 of the fuse 40 that are not coated with the insulating film 49.

When the lever assembly 10 and the cap assembly 50 are mated with each other, the fuse 40 is supported by the fuse clips 70. This process will be described with reference to FIGS. 9A-9C.

Figure 9A:
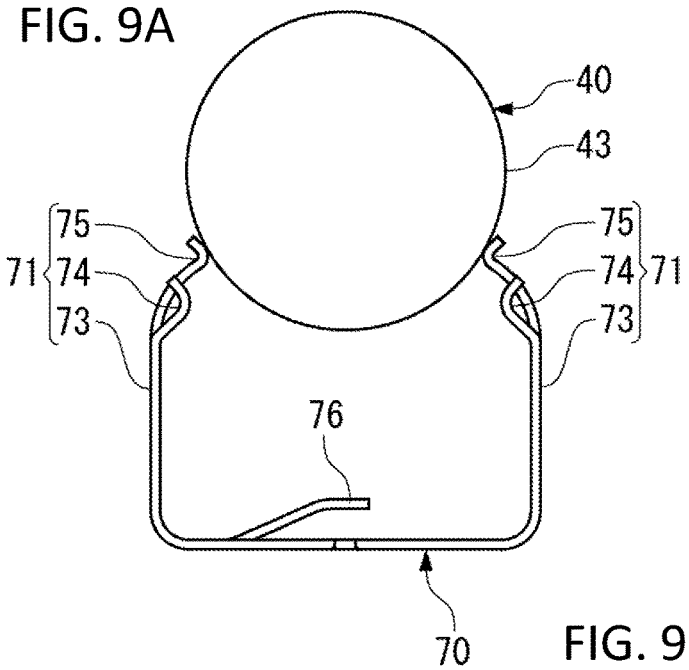
FIG. 9A is a side view of a first step of a process of the fuse clip supporting the fuse.

The fuse 40 is inserted from above into the clearance between the pair of support springs 71, 71. Here, as shown in FIG. 9A, the taller second springs 75, 75 come into contact with the fuse 40 earlier than the first springs 74, 74 come into contact with the fuse 40.

Figure 9B:
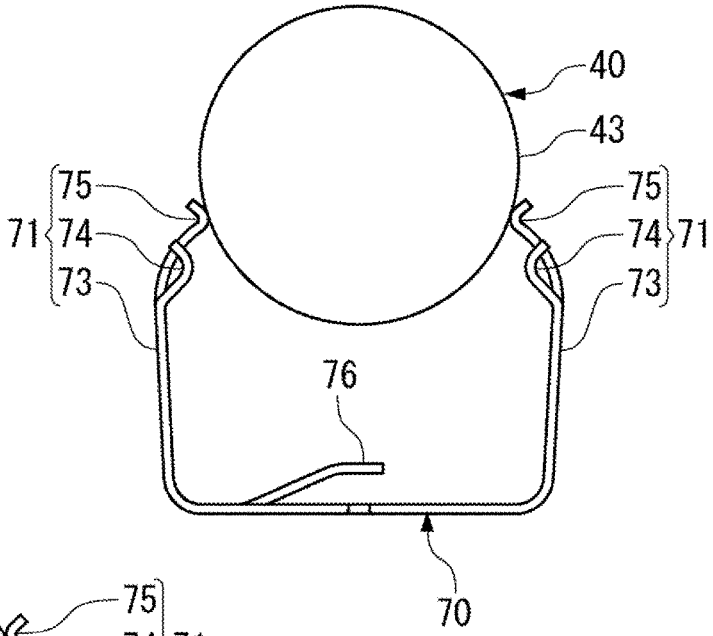
FIG. 9B is a side view of a second step of a process of the fuse clip supporting the fuse.

When the fuse 40 is pressed in downward from this state, the second springs 75, 75 deflect outward so as to be farther apart from each other, as shown in FIG. 9B. Since the load Fs applied by the second springs 75, 75 is set to be small compared with the load Fm applied by the first springs 74, 74, no large force is required to press in the fuse 40. Since the second springs 75, 75 are continuous with the common spring 73, the common spring 73 also deflects outward. As a result, the first springs 74, 74 continuous with the common spring 73 also deflect outward, so that the first spring 74 and the first spring 74 facing each other are farther apart from each other.

Figure 9C:
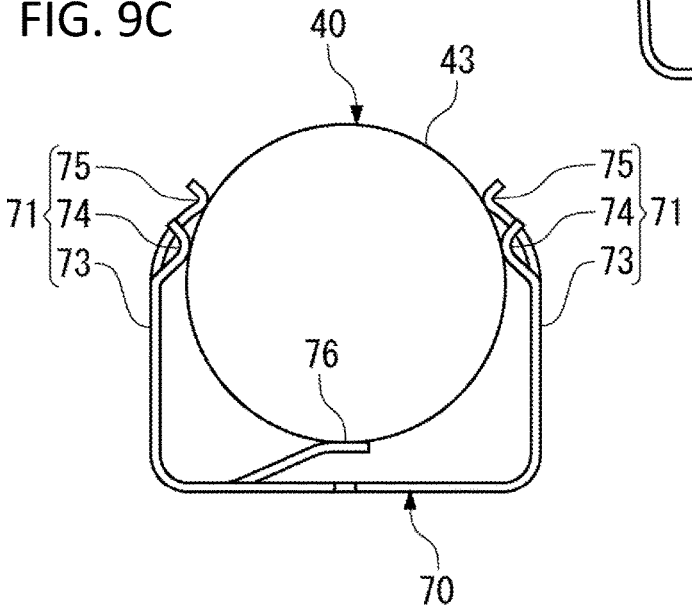
FIG. 9C is a side view of a third step of a process of the fuse clip supporting the fuse.

When the fuse 40 is further pressed in downward, the fuse 40 also comes into contact with the first springs 74, 74 and is subjected to a load. Since the first spring 74 and the first spring 74 have become farther apart from each other, the force required to press in the fuse 40 is reduced accordingly. As shown in FIGS. 7B and 9C, when the fuse 40 is pressed until coming into contact with the third spring 76, the work of supporting the fuse 40 is completed. Thus, the fuse 40 is elastically supported from both sides in the width direction Y by the first springs 74, 74 and the second springs 75, 75 and elastically supported upward in the height direction Z by the third spring 76.

Next, positions at which the first springs 74, 74, the second springs 75, 75, and the third spring 76 support the fuse 40 will be described with reference to FIGS. 10A-10C. The supporting position here refers to a position upon completion of mating of the lever assembly 10 and the cap assembly 50 with each other. Since the connector 1 is used in an environment prone to vibration, the fuse 40 shifts a little repeatedly in the longitudinal direction X, the width direction Y, and the height direction Z.

Figure 10C:
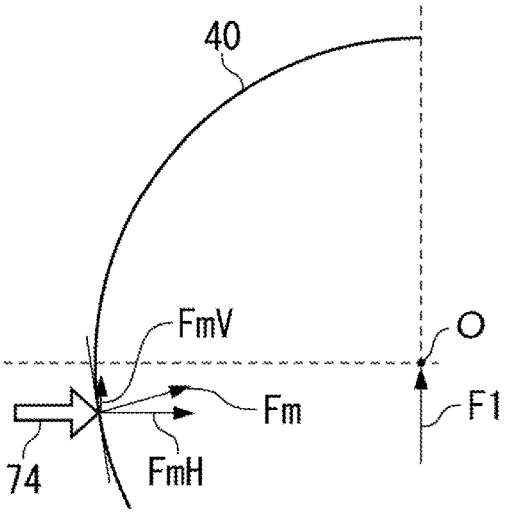
FIG. 10C is a schematic view of the fuse clip supporting the fuse at a position lower than the center of the fuse clip.

In FIGS. 10A-10C, the white arrows indicate the positions at which the first springs 74, 74 support the fuse 40, and the black arrows indicate the positions at which the second springs 75, 75 support the fuse 40. The first springs 74, 74 can support the fuse 40 within the range between the lower white arrow and the upper white arrow. The second springs 75, 75 can support the fuse 40 within the range between the lower black arrow and the upper black arrow. The hatched arrows indicate the positions at which the third spring 76 supports the fuse 40. In FIGS. 10A-10C, the center of the fuse 40 is denoted by reference sign O.

First, the supporting positions of the first springs 74, 74 will be described.

The first springs 74, 74 each come into contact with the fuse 40 at a point of intersection between an outer circumferential surface of the fuse 40 and a line segment L that passes through the center O of the fuse 40 and extends parallel to the width direction Y, or at a position higher than this point of intersection. In short, the first springs 74, 74 support the fuse 40 at positions equal to or higher than the center O.

In a vibration-prone environment, the fuse 40 shifts repeatedly upward and downward in the height direction Z. When the fuse 40 shifts upward, an upward force F1 is applied to the center O of the fuse 40 as shown in FIG. 10B.

If the first springs 74, 74 support the fuse 40 at positions higher than the center O, a downward force is applied to the fuse 40 by the first springs 74, 74 supporting the fuse 40. Specifically, since the outer circumferential surface of the fuse 40 is a circular-arc surface, as shown in FIG. 10B, the load Fm applied from the first spring 74 to the fuse 40 is a resultant force of a horizontal component FmH and a vertical component FmV. Thus, the load Fm has a downward component.

If the first springs 74, 74 support the fuse 40 at positions higher than the center O, the vertical component FmV acts in the downward direction, opposite from the upward force F1 due to vibration. Therefore, the fuse 40 is less likely to slip out of the first springs 74, 74.

As the supporting positions of the first springs 74, 74 are located farther upward of the center O, the downward component of the load Fm becomes larger and the fuse 40 becomes less likely to slip out. If the supporting positions of the first springs 74, 74 are equal to the center O, the load Fm has only a horizontal component.

If, hypothetically, the first springs 74, 74 support the fuse 40 at positions lower than the center O, as shown in FIG. 10C, the load Fm applied from the first spring 74 to the fuse 40 has an upward component FmV. Thus, if the supporting positions of the first springs 74, 74 are lower than the center O, a component of the load Fm due to supporting acts upward in addition to the upward force F1 due to vibration. Therefore, the fuse 40 is more likely to slip out of the first springs 74, 74.

For the above reason, the positions at which the first springs 74, 74 support the fuse 40 are set to positions equal to or higher than the center O in this embodiment. As these supporting positions are located farther upward of the center O, the force required to remove the fuse 40 becomes larger. Specifically, if the supporting positions are located farther upward of the center O, the process of removing the fuse 40 involves an action of pressing the first springs 74, 74 farther apart from each other. This action requires a force exceeding the elastic force of the first springs 74, 74. Therefore, as long as the fuse 40 can be supported in a vibration-prone environment, supporting positions located unnecessarily far upward of the center O should be avoided.

Vibration of the fuse 40 in the width direction Y is also to be taken into account. Then, the positions at which the first springs 74, 74 support the fuse 40 should be near the points of intersection between the outer circumferential surface of the fuse 40 and the line segment L that passes through the center O of the fuse 40, which is also the center of gravity thereof, and extends parallel to the width direction Y.

The supporting position of the first spring 74 can be specified, for example, by the ratio between the diameter D of the fuse 40 and the gap L between the first springs 74, 74 when supporting the fuse 40. When this ratio is referred to as a damping ratio $\alpha 1$, the damping ratio $\alpha 1$ (%) can be specified by the following formula. In this embodiment, the damping ratio $\alpha 1$ is within a range of 0 to 3.0% and, in another embodiment, within a range of 1.0 to 2.0%.

$$\alpha 1=(D-L)/D\times 100(\%)$$

Similarly, the supporting position of the second spring 75 to be described later is specified by $\alpha 2$ (%), and the damping ratio $\alpha 2$ is within a range of 5.0 to 15.0% and, in another embodiment, within a range of 7.0 to 12.0%.

Next, the supporting positions of the second springs 75, 75 will be described.

The second springs 75, 75 support the fuse 40 by coming into contact with the outer circumferential surface of the fuse 40 at positions higher than the positions at which the first springs 74, 74 support the fuse 40. This is because the second springs 75, 75 are intended to prevent the fuse 40 from shifting upward and slipping out of the fuse clip 70. In relation to the supporting positions of the first springs 74, 74, therefore, the second springs 75, 75 always support the fuse 40 at positions higher than the center O. As has been described with reference to FIG. 10B, at these supporting positions, the second springs 75, 75 apply a force having a downward component to the fuse 40 and thus function as a retainer for the fuse 40.

The supporting positions of the second springs 75, 75 may be any arbitrary positions higher than those of the first springs 74, 74. However, as with the first springs 74, 74, supporting positions too far upward of the center O cause an increase in the force required to remove the fuse 40. In an embodiment, the supporting positions are set within a range similar to that shown for the first springs 74, 74.

Next, the supporting position of the third spring 76 will be described.

The third spring 76 supports the fuse 40 upward in the height direction Z. As long as this function can be fulfilled, the supporting position of the third spring 76 may be any arbitrary position. In an embodiment, as shown in FIG. 10A, the third spring 76 support the fuse 40 at a point of intersection between the outer circumferential surface of the fuse 40 and a line segment that passes through the center O of the fuse 40 and extends parallel to the height direction Z. However, the third spring 76 can also support the fuse 40 at a position offset from this point of intersection within a predetermined range in the width direction Y, as indicated by the hatched arrows shown in FIG. 10A.

The fuse clip 70 supports the fuse 40 in the width direction Y by the second springs 75, 75 in addition to the first springs 74, 74. Thus, the fuse 40 can be supported by a load combining the load Fm applied by the first springs 74, 74 and the load Fs applied by the second springs 75, 75.

Because the first springs 74, 74 support the fuse 40 at positions higher than the center O, the fuse 40 is less likely to slip out upward even when subjected to vibration in the height direction Z. Moreover, the second springs 75, 75 support the fuse 40 at higher positions than the first springs 74, 74 support the fuse 40, which makes it even less likely that the fuse 40 slips out upward.

The second springs 75, 75 of the fuse clip 70 are taller than the first springs 74, 74. Accordingly, during insertion of the fuse 40, the second springs 75, 75 come into contact with the fuse 40 earlier, and then the first springs 74, 74 come into contact with the fuse 40 after a time interval. This can reduce the initial burden of the work of inserting the fuse 40, compared with when, during insertion of the fuse 40, the fuse 40 is subjected to the load combining the load Fm and the load Fs at once and moreover remains under the same load throughout the insertion process. During removal of the fuse 40, the fuse 40 is at first subjected to the load combining the load Fm and the load Fs at once, but is at some point relieved of the load Fm applied by the first springs 74, 74, so that the burden of the work can be reduced.

The first springs 74, 74 and the second springs 75, 75 of the fuse clip 70 are connected to the common springs 73 in this embodiment. This allows for a reduction of the force required to insert the fuse 40 into the fuse clip 70. Specifically, the common springs 73 deflect in conjunction with the second springs 75, 75 when the second springs 75, 75 come into contact with the fuse 40 earlier and deflect so as to be farther apart from each other. Further, the first springs 74, 74 deflect in conjunction with the common springs 73 when the common springs 73 deflect, so as to be farther apart from each other. As a result, a smaller force is required to insert the fuse 40 into the clearance between the first springs 74, 74. In particular, the elastic force of the second springs 75, 75 is set to be small compared with that of the first springs 74, 74 in this embodiment, so that a smaller force is required to press the first springs 74, 74 farther apart from each other.

The fuse clip 70 of the embodiment makes linear contact at the contact points 74A, 75A, and other portions than the contact points 74A, 75A can be formed in a substantially flat shape. The embodiment can thereby reduce the burden of the work of inserting and removing the fuse 40.

In the above embodiment, two fuse clips 70 produced as discrete pieces support one fuse 40, however, in other embodiments, two fuse clips 70 can also be produced as an integral piece to support the fuse 40.

As long as the respective functions of the common spring 73, the first springs 74, 74, the second springs 75, 75, and the third spring 76 can be fulfilled, the specifications, including the dimensions, of these springs are arbitrary. For example, the specifications can be adjusted according to the dimensions, vibration conditions, etc. of the fuse 40.

Figure 11A:
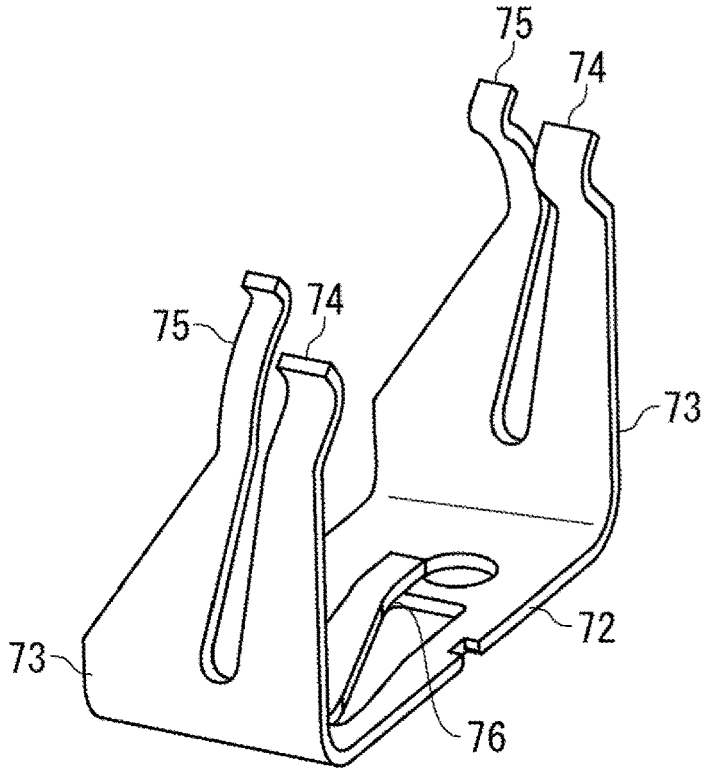
FIG. 11A is a perspective view of a fuse clip according to another embodiment.

As the dimension of the common spring 73 in the height direction Z becomes larger, the elastic force of the support spring 71 as a whole becomes larger. While a larger elastic force is supports the fuse 40, a larger force is required to insert the fuse 40 into the fuse clip 70. To reduce the force required for insertion, this dimension of the common spring 73 can be reduced as shown in FIG. 11A.

Figure 11B:
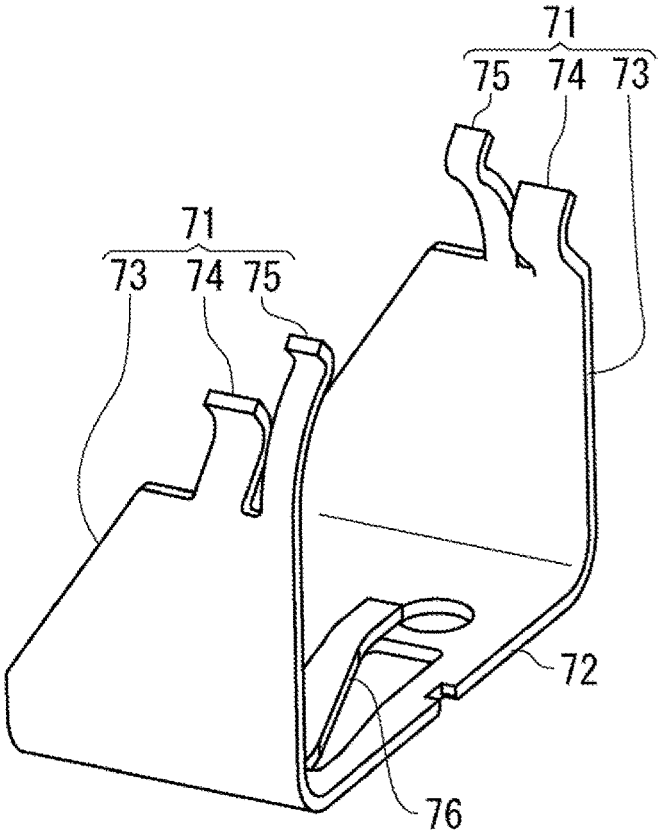
FIG. 11B is a perspective view of a fuse clip according to another embodiment.

The first springs 74, 74 and the second springs 75, 75 are arranged in the fuse clip 70 such that the first spring 74 and the first spring 74 face each other and that the second spring 75 and the second spring 75 face each other. However, this is merely an example, and the first springs 74, 74 and the second springs 75, 75 may instead be arranged such that the first spring 74 and the second spring 75 face each other as shown in FIG. 11B.

The elastic force with which the first spring 74 elastically supports the fuse 40 is set to be larger than that of the second spring 75 in the above embodiment, but the present invention is not limited to this embodiment. The above-described effects of the present invention can be produced even when, for example, the elastic force with which the first spring 74 elastically supports the fuse 40 is equal to or smaller than that of the second spring 75.

What is claimed is:

1. A fuse clip, comprising:

a pair of first springs configured to support a fuse having a cylindrical body part from a radially outer side, the first springs are configured to elastically support the cylindrical body part at a point of intersection between a horizontal line segment passing through a center of the cylindrical body part and an outer circumferential surface of the cylindrical body part or at a position higher than the point of intersection; and a pair of second springs disposed side by side with the first springs in an axial direction of the fuse and configured to elastically support the fuse from the radially outer side, the second springs extend further from a common spring than the first springs, and are configured to elastically support the cylindrical body part at a higher position with respect to the point of intersection than the first springs elastically support the cylindrical body part.

2. The fuse clip of claim 1, wherein the first springs are configured to elastically support the cylindrical body part with an elastic force larger than an elastic force with which the second springs elastically support the body part.

3. The fuse clip of claim 1, wherein, the first springs and the second springs are connected to the common spring.

4. The fuse clip of claim 1, wherein the second springs deflect toward the radially outer side by contacting the cylindrical body part.

5. The fuse clip of claim 4, wherein the common spring is configured to deflect toward the radially outer side in conjunction with the second springs.

6. The fuse clip of claim 5, wherein the second springs contact the cylindrical body part before the first springs contact the cylindrical body part.

7. The fuse clip of claim 6, wherein the first springs are configured to deflect toward the radially outer side in conjunction with the common spring, so as to support the cylindrical body part.

8. The fuse clip of claim 1, wherein the first springs and the second springs are configured to support the cylindrical body part by linearly contacting the cylindrical body part.

9. The fuse clip of claim 1, further comprising a third spring configured to support the body part upward in a vertical direction.

10. A connector, comprising:

a first housing that accommodates a fuse clip;

a second housing that is mated with the first housing and accommodates the fuse clip in combination with the first housing;

a lever that is supported by the first housing and configured to be operated toward a mating position to mate the first housing and the second housing with each other; and a fuse clip fixed to the second housing and configured to elastically support a fuse, the fuse clip including:

a pair of first springs configured to support the fuse having a cylindrical body part from a radially outer side, the first springs are configured to elastically support the cylindrical body part at a point of intersection between a horizontal line segment passing through a center of the cylindrical body part and an outer circumferential surface of the cylindrical body part or at a position higher than the point of intersection; and a pair of second springs disposed side by side with the first springs in an axial direction of the fuse and configured to elastically support the fuse from the radially outer side, the second springs are configured to elastically support the cylindrical body part at a higher position with respect to the point of intersection than the first springs elastically support the cylindrical body part.

* * * * *